US009052689B2

(12) United States Patent
Saeki et al.

(10) Patent No.: US 9,052,689 B2
(45) Date of Patent: Jun. 9, 2015

(54) IMAGE FORMING APPARATUS

(71) Applicants: Masahito Saeki, Nagoya (JP); Hidekazu Nogami, Nagoya (JP); Koyo Yamamoto, Nisshin (JP)

(72) Inventors: Masahito Saeki, Nagoya (JP); Hidekazu Nogami, Nagoya (JP); Koyo Yamamoto, Nisshin (JP)

(73) Assignee: Brother Kogyo Kabushiki Kaisha, Nagoya-shi, Aichi-ken, (JP)

( * ) Notice: Subject to any disclaimer, the term of this patent is extended or adjusted under 35 U.S.C. 154(b) by 0 days.

(21) Appl. No.: 13/754,083

(22) Filed: Jan. 30, 2013

(65) Prior Publication Data

US 2013/0195500 A1 Aug. 1, 2013

(30) Foreign Application Priority Data

Jan. 31, 2012 (JP) ..... 2012-017773

(51) Int. Cl.
*G03G 21/20* (2006.01)
*G03G 15/20* (2006.01)

(52) U.S. Cl.
CPC ..... *G03G 21/203* (2013.01); *G03G 15/2017* (2013.01); *G03G 21/206* (2013.01)

(58) Field of Classification Search
CPC ..... G03G 15/2017; G03G 21/206; G03G 21/203; G03G 2215/00776
USPC ..... 399/92, 97, 107
See application file for complete search history.

(56) References Cited

U.S. PATENT DOCUMENTS

| | | | | |
|---|---|---|---|---|
| 7,194,222 | B2 | 3/2007 | Murooka | |
| 2005/0232653 | A1 | 10/2005 | Murooka | |
| 2010/0003048 | A1 * | 1/2010 | Yamazoe | 399/92 |

FOREIGN PATENT DOCUMENTS

| | | | |
|---|---|---|---|
| JP | 62-057276 | U | 4/1987 |
| JP | H09-281825 | A | 10/1997 |
| JP | 2000-293075 | A | 10/2000 |
| JP | 2003-215962 | A | 7/2003 |
| JP | 2005-077478 | A | 3/2005 |
| JP | 2005-164888 | A | 6/2005 |
| JP | 2007-086123 | A | 4/2007 |
| JP | 2010282057 | A | 12/2010 |
| JP | 2011-095569 | A | 5/2011 |

OTHER PUBLICATIONS

Jan. 15, 2015—(EP) Extended European Search Report—App 13153159.2.
Jan. 19, 2015—(CN) First Office Action—App 201310036362.1.

* cited by examiner

*Primary Examiner* — David Gray
*Assistant Examiner* — Sevan A Aydin
(74) *Attorney, Agent, or Firm* — Banner & Witcoff, Ltd.

(57) ABSTRACT

An image forming apparatus includes: a main body casing; a fixing unit accommodated in the casing and including a heating member and a pressing member; a first wall provided inside the casing at a position above the heating member and the pressing member and extending diagonally downward and forward; an uneven portion provided on the first wall at a position rearward of front end portion of the pressing member to restrain a dew droplet condensed on the first wall from running down along the first wall; a sheet ejection opening formed in the casing such that the recording sheet conveyed out from the fixing unit is ejected outside the casing through the sheet ejection opening; and an exhaust opening formed in the casing at a position rearward of the heating member such that air heated in the fixing unit is discharged outside the casing through the exhaust opening.

20 Claims, 7 Drawing Sheets

IMAGE FORMING APPARATUS

CROSS-REFERENCE TO RELATED APPLICATION(S)

This application claims priority from Japanese Patent Application No. 2012-017773 filed on Jan. 31, 2012, the disclosure of which is incorporated herein by reference in its entirety.

TECHNICAL FIELD

The present invention relates to an image forming apparatus including a fixing device for thermally fixing a developer image on a recording sheet.

BACKGROUND ART

There is known an image forming apparatus having a fixing device and a sheet ejection opening for ejecting paper (recording sheet), which are provided in an upper part of a main body casing, and air heated by the fixing device is discharged through the sheet ejection opening (see, for example, JP2000-293075 A). More specifically, the fixing device has a heating roller and a pressing roller arranged one behind another in the front-rear direction, and a slanted wall extending diagonally upward and rearward to the sheet ejection opening is provided above the heating roller and the pressing roller.

With this configuration, air heated by the fixing device flows along the slanted wall and is discharged through the sheet ejection opening. Further, a downwardly extending projection is provided on the slanted wall at a position rearward of the center of the pressing roller.

However, according to this image forming apparatus, when paper is heated by the heating roller, moisture contained in the paper vaporizes and flows, together with the heated air, along the slanted wall. Therefore, if the slanted wall is cool, water vapor may be cooled by the slanted wall and dew condensation may occur. In particular, the slanted wall is likely to be cooled by the outside air at a region closer to the sheet ejection opening, with the result that dew condensation is more likely to occur in this region of the slanted wall.

Once dew condensation occurs and dew droplets are condensed on the slanted wall at the region closer to the sheet ejection opening, the dew droplets run down along the slanted wall in a diagonally downward and frontward direction and then they are stopped by the projection, so that, at the projection of the slanted wall, the dew droplets drop and may disadvantageously adhere to the paper being conveyed toward the sheet ejection opening. If the dew droplets drop on the paper, an image formed on the paper may be stained with the dew droplets and the image quality of the printed paper may be degraded.

In view of the above, it would be desirable to provide an image forming apparatus which can restrain dew droplets caused by dew condensation from adhering to paper (recording sheet) so as to suppress degradation of the printed image.

SUMMARY OF THE INVENTION

According to the present invention, there is provided an image forming apparatus which comprises: a main body casing; a fixing unit accommodated in the main body casing and including a heating member configured to thermally fix a developer image on a recording sheet, and a pressing member disposed opposite to the heating member at a position diagonally upward and rearward of the heating member and configured to convey the recording sheet while the recording sheet is nipped between the heating member and the pressing member; a first wall provided inside the main body casing at a position above the heating member and the pressing member and configured to extend diagonally downward and frontward; an uneven portion provided on the first wall at a position rearward of a front end portion of the pressing member and configured to restrain a dew droplet condensed on the first wall from running down along the first wall; a sheet ejection opening formed in the main body casing such that the recording sheet conveyed out from the fixing unit is ejected outside the main body casing through the sheet ejection opening; and an exhaust opening formed in the main body casing at a position rearward of the heating member such that air heated in the fixing unit is discharged outside the main body casing through the exhaust opening.

BRIEF DESCRIPTION OF THE DRAWINGS

To better understand the claimed invention, and to show how the same may be carried into effect, reference will now be made, by way of example only, to the accompanying drawings, in which:

DESCRIPTION OF EMBODIMENT

Figure 1:
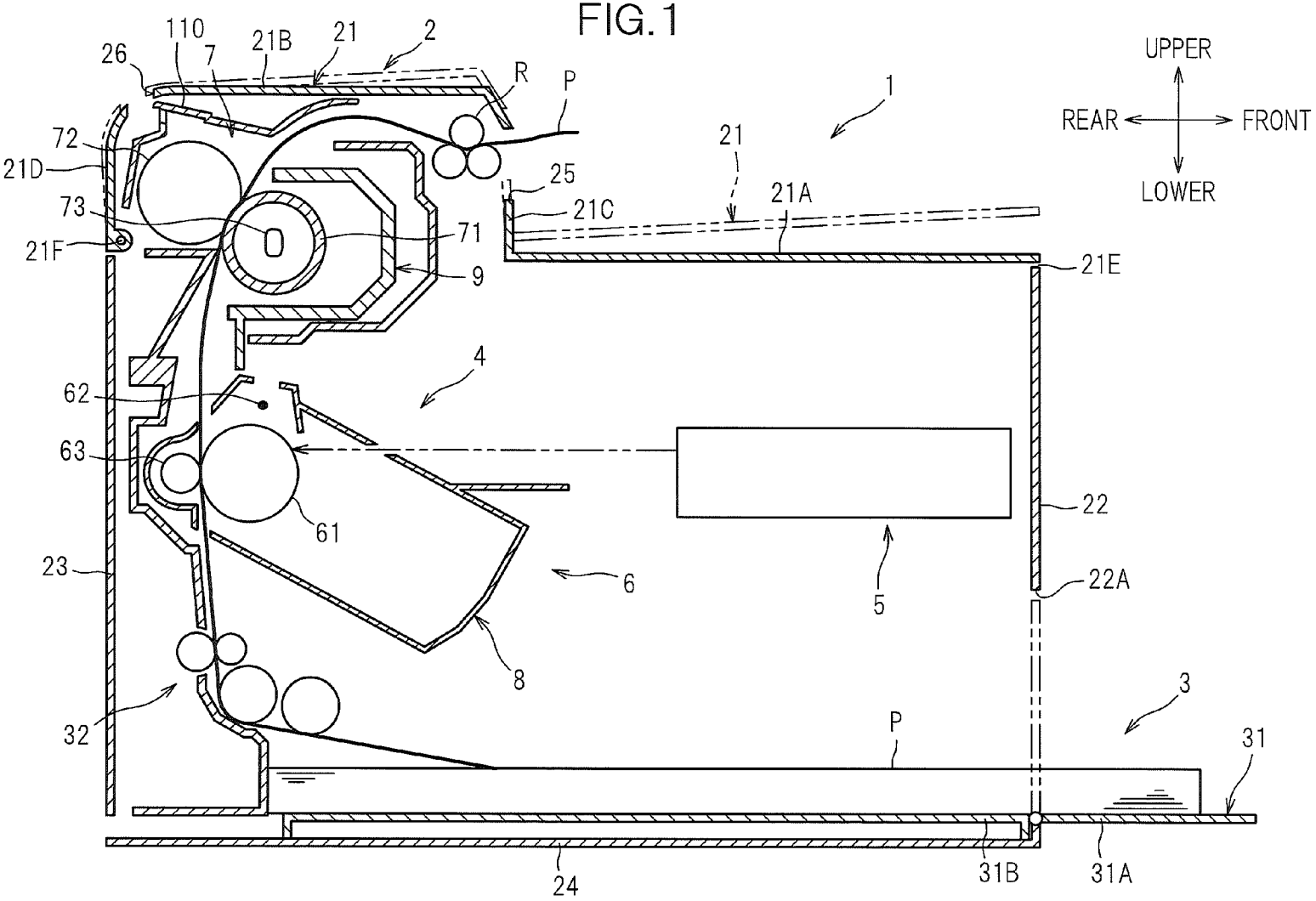
FIG. 1 is a sectional view schematically showing a laser printer according to one exemplary embodiment of the present invention.

A detailed description will be given of an illustrative embodiment of the present invention with reference to the accompanying drawings. In the following description, a general arrangement of a laser printer as an example of an image forming apparatus will be described, and thereafter characteristic features of the present invention will be described in detail.

In the following description, the direction is designated as from the viewpoint of a user who is using (operating) the laser printer. To be more specific, in FIG. 1, the right-hand side of the drawing sheet corresponds to the "front" side of the laser printer, the left-hand side of the drawing sheet corresponds to the "rear" side of the laser printer, the front side of the drawing sheet corresponds to the "left" side of the laser printer, and the back side of the drawing sheet corresponds to the "right" side of the laser printer. Similarly, the direction extending from top to bottom of the drawing sheet corresponds to the "vertical" or "upper-lower" (upward/downward, up/down, upper/lower or top/bottom) direction of the laser printer.

As seen in FIG. 1, a laser printer 1 includes a main body casing 2, and several components housed within the main body casing 10 which include a sheet feeder unit 3 for feeding a sheet of paper P (hereinafter simply referred to as a "sheet" P) as an example of a recording sheet, and an image forming unit 4 for forming an image on a sheet P.

The main body casing 2 mainly includes an upper wall portion 21, a front wall portion 22, a rear wall portion 23, a lower wall portion 24, and right and left side wall portions (shown without reference numerals). The upper wall portion 21 has a front portion 21A and a rear portion 21B. The front portion 21A of the upper wall portion 21 extends at a level one step lower than the rear portion 21B to provide a sheet output tray for placing sheets P ejected outside the main body casing 2.

A front vertical wall portion 21C connects the front portion 21A and the rear portion 21B, and a sheet ejection opening 25 is formed in the front vertical wall portion 21C. A sheet P discharged from a fixing unit 7 to be described later is ejected outside the main body casing 2 through the sheet ejection opening 25. Further, the rear portion 21B and the rear wall portion 23 are connected by a rear vertical wall portion 21D, and an exhaust opening 26 in the form of a plurality of slits is formed between the rear vertical wall portion 21D and the rear portion 21B. Air heated in the fixing unit 7 is discharged outside the main body casing 2 through the exhaust opening 26.

An opening 21E is formed in an upper part of the main body casing 2 so that the inside and the outside of the main body casing 2 are in communication through the opening 21E. The opening 21E is opened and closed by swinging the upper wall portion 21 around a pivot shaft 21F of the upper wall portion 21.

To be more specific, the sheet ejection opening 25 is disposed frontward of a heating roller 71 to be described later. The sheet ejection opening 25 is formed in the shape of a slot extending in the right-left direction to thereby allow a sheet P to pass therethrough. The exhaust opening 26 is disposed rearward of the heating roller 71 such that the plurality of slits are spaced apart in the right-left direction (see FIG. 3).

An opening 22A is formed in a lower part of the front wall portion 22 so that the inside and the outside of the main body casing 2 are in communication through the opening 22A. A sheet feeder cover 31A is provided for opening and closing the opening 22A.

The sheet feeder unit 3 includes a sheet feed tray 31 to be formed in a lower part of the main body casing 2, and a sheet feed mechanism 32 for feeding a sheet P from the sheet feed tray 31 toward the image forming unit 4.

The sheet feed tray 31 includes the sheet feeder cover 31A as described above, and a tray portion 31B disposed in the lower space within the main body casing 2. To be more specific, the sheet feeder cover 31A is swingable in the front-rear direction around its lower end portion. When the sheet feeder cover 31A is opened frontward into a lying back position, an upper surface of the sheet feeder cover 31 A becomes substantially flush with an upper surface of the tray portion 31 B to thereby form a part of the sheet feed tray 31.

In this sheet feeder unit 3, the sheet feeder cover 31A is swung open into the lying back position to form the sheet feed tray 31, and sheets P are placed in the sheet feed tray 31. The sheets P stored in the sheet feed tray 31 are urged upward by a sheet pressure plate (not shown) toward the sheet feed mechanism 32, by which a sheet P is supplied one by one to the image forming unit 4.

The image forming unit 4 includes a scanner unit 5, a process unit 6, and a fixing unit 7.

The scanner unit 5 is disposed in the main body casing 2 at a front upper part thereof, and includes a laser beam emitting portion, a polygon mirror, lenses, reflecting mirrors, etc., all of which are not shown in the drawings. In the scanner unit 5, a surface of a photoconductor drum 61 to be described later is swept out by a laser beam for high speed scanning.

The process unit 6 is detachably mounted to the main body casing 2 through the opening 21E. The process unit 6 includes a photoconductor drum 61, a charging wire 62 configured to charge the photoconductor drum 61 by an electric discharge, a transfer roller 63 configured to transfer a toner image (developer image) on the photoconductor drum 61 onto a sheet P, and a process unit casing 8. A grid electrode having a plurality of slits may be provided below the charging wire 62.

The process unit casing 8 accommodates the photoconductor drum 61, the charging wire 62, and the transfer roller 63. Further, a development roller, doctor blade, and a toner storage chamber, which are conventionally known parts and not shown in the drawings, are provided in the process unit casing 8.

In this process unit 6, the surface of the rotating photoconductor drum 61 is uniformly charged by the charging wire 62, and then exposed to a rapidly sweeping laser beam from the scanner unit 5. Therefore, the electric potential of the exposed area lowers, so that an electrostatic latent image associated with image data is formed on the surface of the photoconductor drum 61.

Toner in the toner storage chamber is then supplied to the electrostatic latent image on the photoconductor drum 61 via the development roller, so that a toner image is formed on the surface of the photoconductor drum 61. Thereafter, while a sheet P is conveyed through between the photoconductor drum 61 and the transfer roller 63, the toner image carried on the surface of the photoconductor drum 61 is transferred onto the sheet P.

The fixing unit 7 is disposed above the process unit 6. The fixing unit 7 includes a heating roller 71 as an example of a heating member, a pressure roller 72 as an example of a pressing member, and a fixing unit casing 9 for accommodating the heating roller 71.

The heating roller 71 is configured to heat a sheet P, and a halogen lamp 73 (heat source) is provided within the heating roller 71.

The pressure roller 72 is pressed against the heating roller 71 and conveys a sheet P while the sheet P is nipped between the heating roller 71 and the pressure roller 72. The pressure roller 72 is disposed opposite to the heating roller 71 at a position diagonally upward and rearward of the heating roller 71.

In this fixing unit 7 configured as described above, the toner transferred onto the sheet P is thermally fixed while the sheet P passes through between the heating roller 71 and the pressure roller 72. The sheet P with the toner thermally fixed thereon by the fixing unit 7 is conveyed to a sheet ejection roller R disposed frontward of the fixing unit 7, and is ejected by the sheet ejection roller R onto the sheet output tray (front portion 21A) through the sheet ejection opening 25.

Structure of Fixing Unit 7 and Therearound

Figure 2:
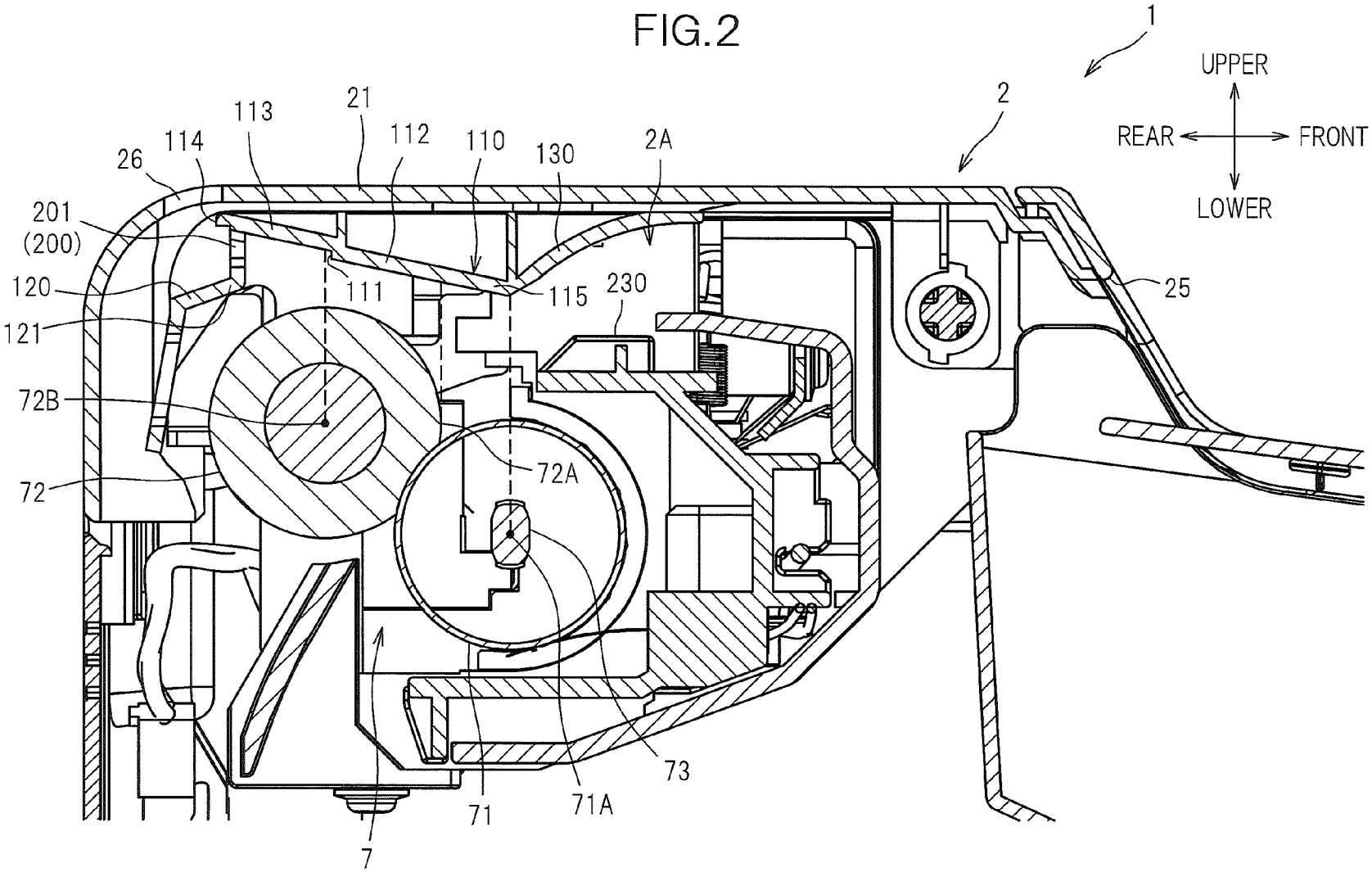
FIG. 2 is an enlarged sectional view showing the structure of a fixing unit and around the fixing unit.
Figure 3:
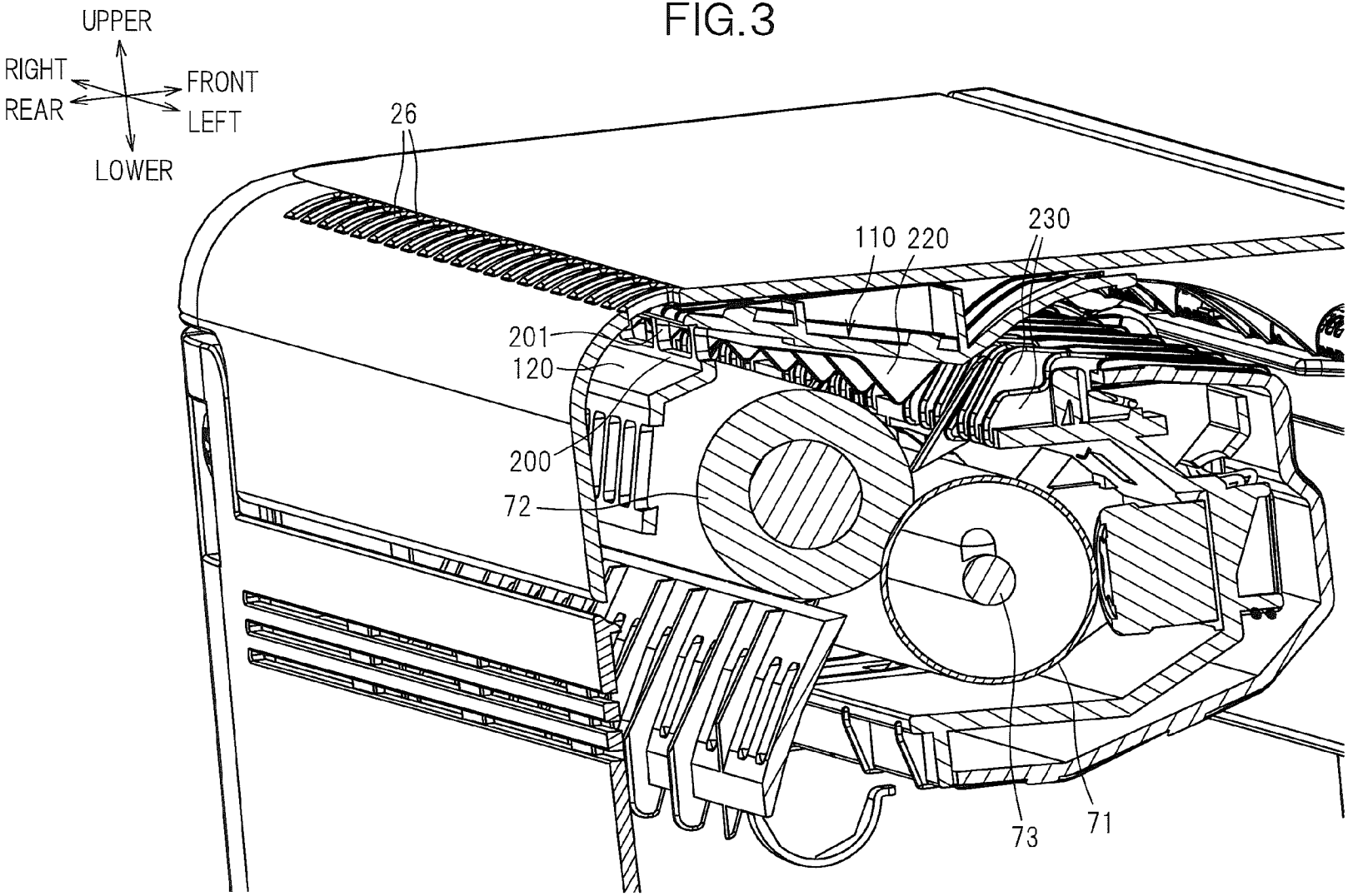
FIG. 3 is a partially cutaway perspective view showing the structure of the fixing unit and around the fixing unit.

As seen in FIGS. 2 and 3, a first wall 110 is provided at a position above the pressure roller 72 and the heating roller 71. The first wall 10 extends diagonally downward and frontward.

The first wall 110 extends outward in the right-left direction beyond the heating roller 71 and is configured to guide air heated by the heating roller 71 toward the exhaust opening 26 provided at a position diagonally upward and rearward of the heating roller 71. To be more specific, the first wall 110 extends to a position substantially corresponding to the center 71A of the heating roller 71 in the front-rear direction.

A stepped portion 111 as an example of an uneven portion is provided on the first wall 110 at a position rearward of a front end portion 72A of the pressure roller 72, more specifically, at a position substantially corresponding to the center 72B of the pressure roller 72 in the front-rear direction. The first wall 110 has a front portion 112 and a rear portion 113 shifted upward with respect to the front portion 112, and the stepped portion 111 connects between the front portion 112 and the rear portion 113. The stepped portion 111 restrains dew droplets condensed on the rear portion 113 of the first wall 110 from running down along the first wall 110.

Namely, the stepped portion 111 for restraining a dew droplet from running down along the first wall 110 is provided at a side remote from and opposite to the sheet ejection opening 25 in the front-rear direction with the nip portion between the heating roller 71 and the pressure roller 72 being located between the stepped portion 111 and the sheet ejection opening 25 (i.e., at a position not overlapping a sheet conveyance passage 2A, along which a sheet P is conveyed, as viewed from the upper-lower direction). Accordingly, even if dew droplets gathered at the stepped portion 111 drop down, the dew droplets do not directly adhere to a sheet P to thereby suppress degradation of the printed image.

Further, since the uneven portion is configured as the stepped portion 111 which is provided between the front portion 112 and the rear portion 113 shifted upward with respect to the front portion 112, the heated air flowing from the heating roller 71 toward the exhaust opening 26 can be guided smoothly as compared to the configuration in which, for example, the uneven portion is formed as a projection downwardly extending from the lower surface of the first wall. This can restrain hot air from being discharged through the sheet ejection opening 25 for sheets P.

Further, the first wall 110 is configured such that, as viewed from the upper-lower direction, a rear end portion 114 of the first wall 110 ends at a position overlapping the exhaust opening 26 formed in an upper wall 21 disposed above the first wall 110. With this configuration, the heated air guided by the lower surface of the first wall 110 flows upward after passing by the rear end portion 114 of the first wall 110, and is discharged outside the main body casing 2 through the exhaust opening 26 provided directly above the rear end portion 114 of the first wall 110. Therefore, it is possible to restrain moist air derived from moisture in a sheet P from staying within the main body casing 2.

A second wall 120 opposite to (overlapping) the first wall 110 in the upper-lower direction is provided below the rear end portion 114 of the first wall 110. The second wall 120 extends diagonally downward and rearward, and a front end portion 121 of the second wall 120 overlaps the rear end portion 114 of the first wall 110 as viewed from the upper-lower direction.

To be more specific, a connecting wall 200 is formed between the front end portion 121 of the second wall 120 and the rear end portion 114 of the first wall 110 so that the front end portion 121 and the rear end portion 114 are connected by the connecting wall 200, and the rear end portion 114 of the first wall 110 extend rearward beyond the connecting wall 200. Further, the connecting wall 200 has a plurality of through-holes 201 for allowing the air heated by the heating roller 71 to pass therethrough. The through-hoes 201 are spaced apart in the right-left direction.

As described above, since the rear end portion 114 of the first wall 110 extends rearward beyond the connecting wall 200 (i.e., the front end portion 121 and the rear end portion 114 overlap each other as viewed from the upper-lower direction), even if a dew droplet enters the main body casing 2 through the exhaust opening 26 and drops onto the rear end portion 114 of the first wall 110, the dew droplet which will drop down from the rear end portion 114 can be reliably received by the second wall at a position spaced part from and rearward of the front end edge of the front end portion 121 of the second wall 120. Therefore, it is possible to prevent water droplets dropping from the rear end portion 114 of the first wall 110 from entering the fixing unit 7 through the plurality of through-hoes 201.

Further, since the second wall 120 extends diagonally downward and rearward, dew droplets received by the second wall can be distanced away from the heating roller 71.

At the front end portion 115 of the first wall 110, there is provided a third wall 130 for guiding a sheet P conveyed by the heating roller 71 and the pressure roller 72 toward the sheet ejection opening 25. The third wall 130 has an upwardly recessed circular arc-shaped cross-section and extending diagonally upward and frontward from the first wall 110. The third wall 130 is integrally formed with the first wall 110.

With this configuration, since the sheet P is guided by the third wall 130 toward the sheet ejection opening 25 provided at a position diagonally upward and frontward of the nip portion between the heating roller 71 and the pressure roller 72, the sheet P can be smoothly ejected outside the main body casing 2 through the sheet ejection opening 25. Further, since the first wall 110 and the third wall 130 are integrally formed with each other, no gap is present between the first wall 110 and the third wall 130, as compared to the configuration in which, for example, the first wall and the third wall are formed as discrete parts and an unintentional gap is present between them so that air flows through the gap and stays in an upper region within the main body casing. Therefore, it is possible to restrain moist air derived from moisture in the sheet P from flowing upward through between the first wall 110 and the third wall 130 and staying within the main body casing 2.

Further, a plurality of guide ribs 230 as an example of a guide member are provided below the third wall 130. The guide ribs 230 are provided at a position frontward of the center 71A of the heating roller 71 and spaced apart from each other in the right-left direction. The guide ribs 230 are configured to support a lower surface of the sheet P conveyed by the heating roller 71 and the pressure roller 72 and to guide the sheet P to the sheet ejection opening 25.

Figure 4:
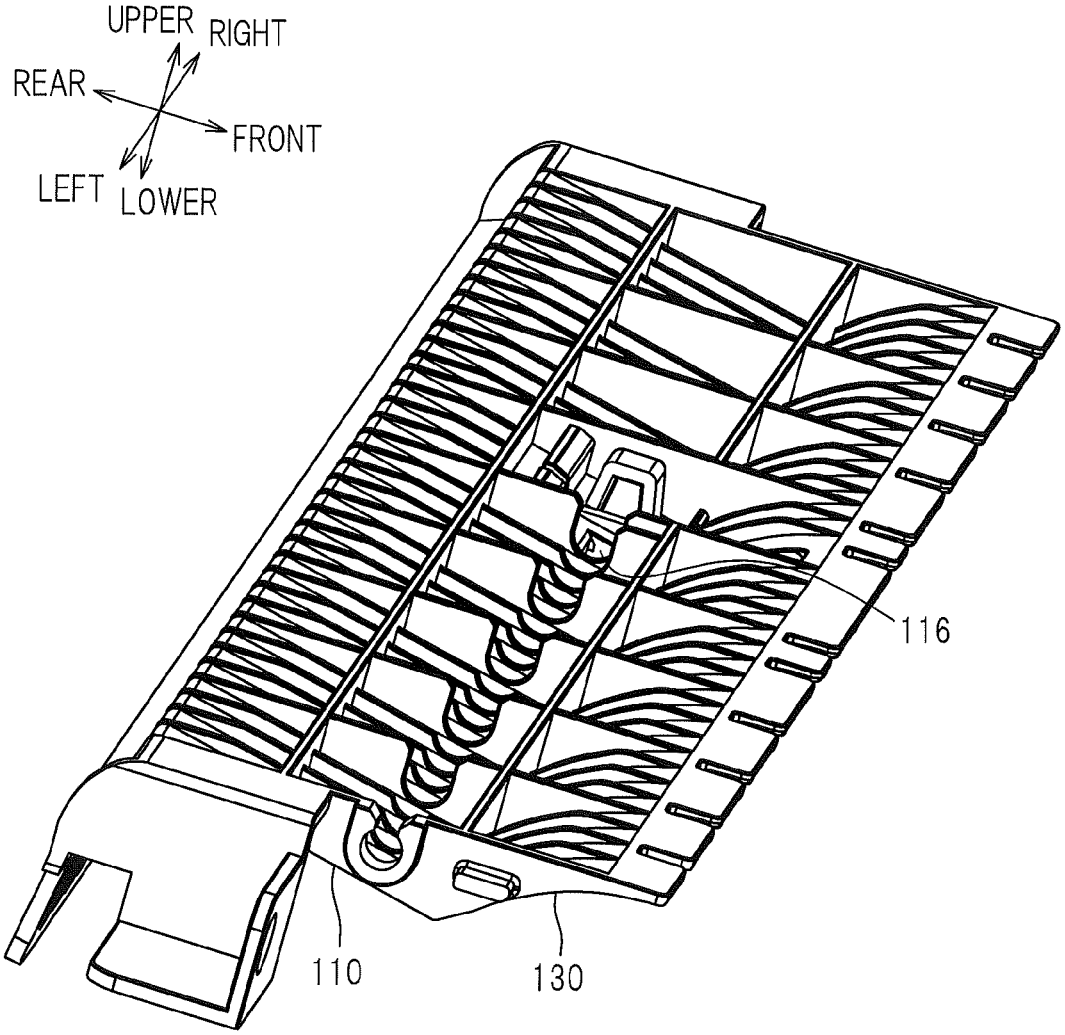
FIG. 4 is a perspective view of a first wall and a third wall as viewed from above.
Figure 5:
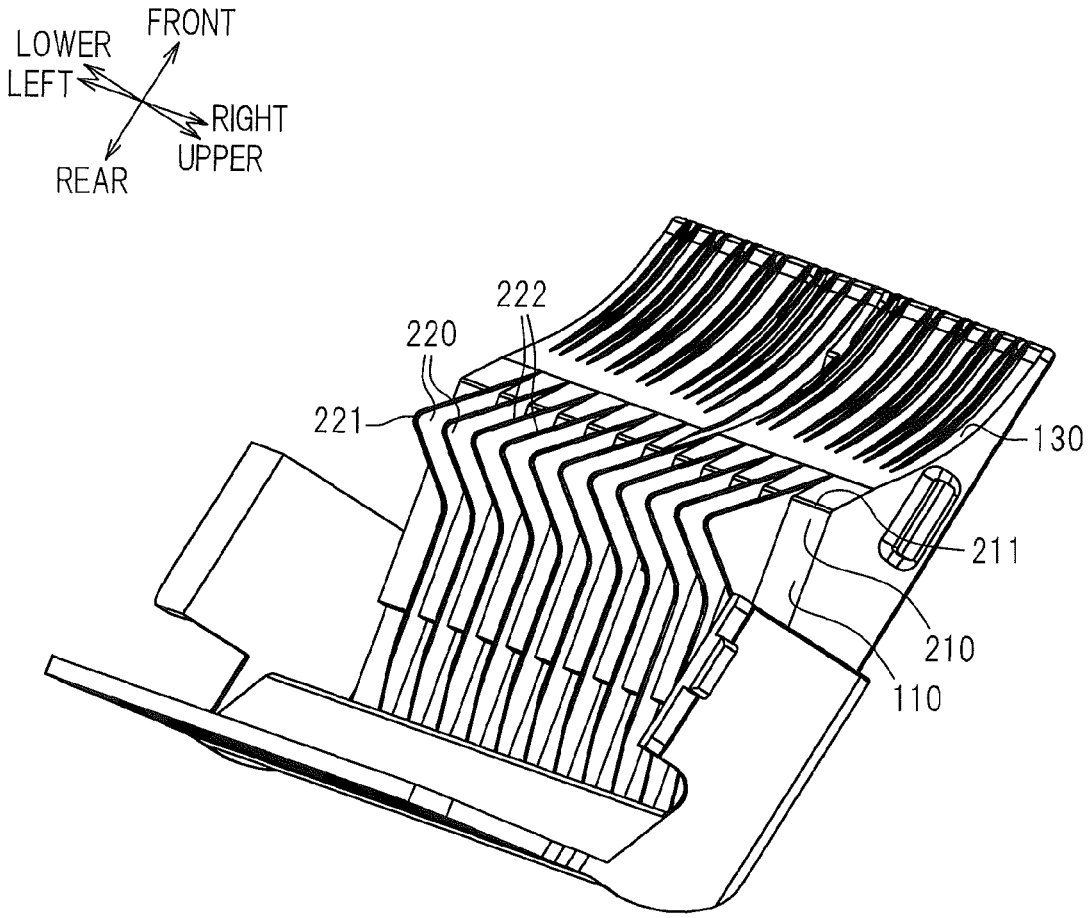
FIG. 5 is a perspective view of the first wall and the third wall as viewed from below.

As seen in FIGS. 4 and 5, a plurality of ribs 220 are provided in positions spaced apart from each other in the right-left direction, at a lower surface of a corner portion 210 at which the first wall 110 and the third wall 130 are connected and which has a triangular cross-section, and each of the ribs 220 protrudes downward to form a downwardly narrowing portion. Lower-most portions 221 of the ribs 220 are arranged rearward of the lower-most portion 211 of the corner portion 210.

Figure 6:
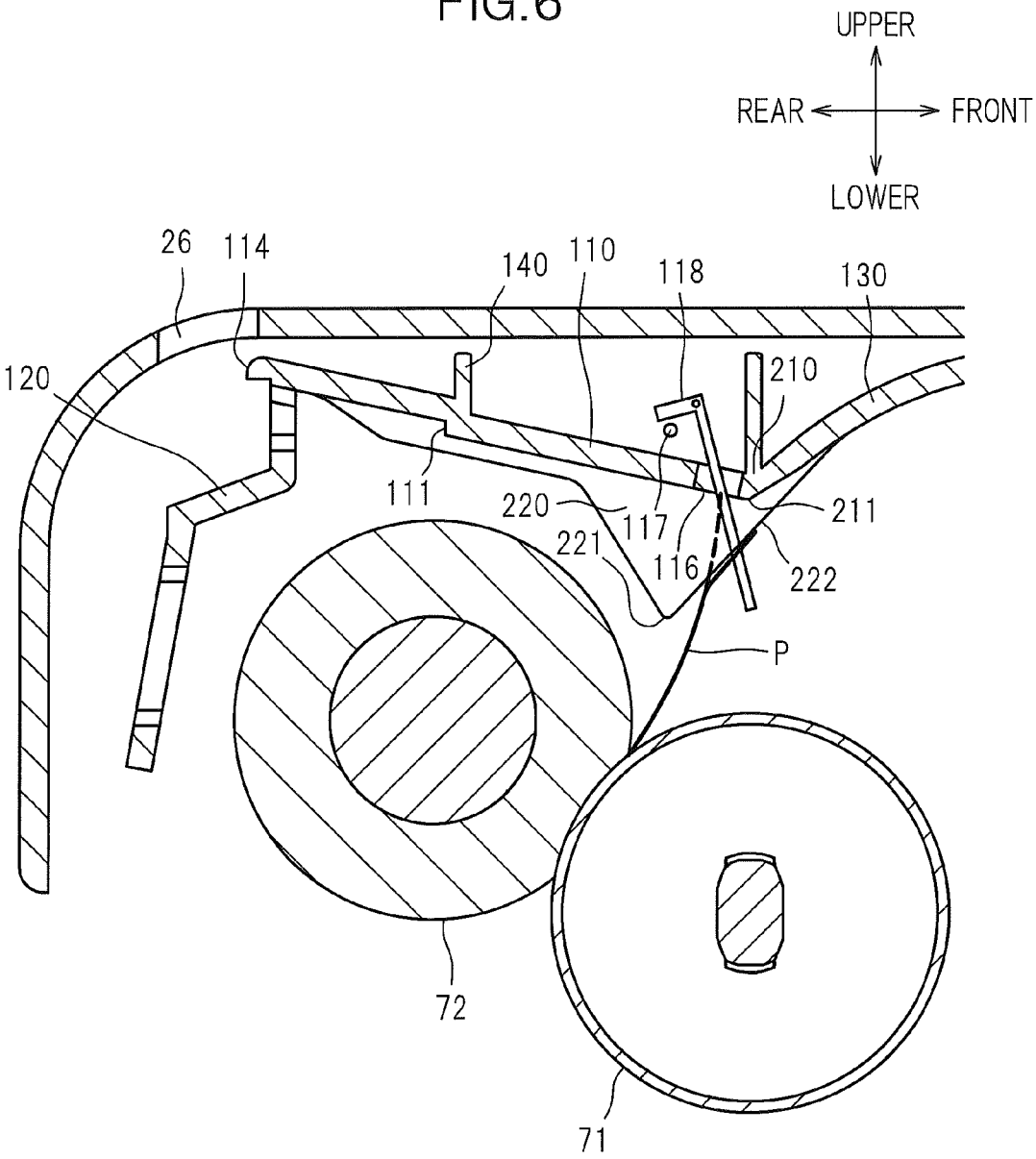
FIG. 6 is a sectional view schematically showing the structure of the fixing unit and around the fixing unit.

To be more specific, as seen in FIG. 6, a front surface 222 extending diagonally upward and frontward from the lower-most portion 221 of each rib 220 extends to pass through a portion below the lower-most portion 211 of the corner portion 210 and is connected to a portion of the corner portion 210 at a position frontward of the lower-most portion 211 of the corner portion 210. With this configuration, even if the sheet P conveyed by the heating roller 71 and the pressure roller 72 curls upward and the leading end of the sheet P is conveyed toward a surface disposed rearward of the lower-most portion 211 of the corner portion 210 (see the dashed line in the figure), the leading end of the sheet P comes into contact with the front surfaces 222 of the ribs 220, so that the front surfaces 222 of the ribs 220 can guide the sheet P smoothly toward the third wall 130.

Namely, if the ribs 220 are not provided on the lower surface of the corner portion 210, the leading end of the sheet P would be trapped by the lower-most portion 211 of the corner portion 210. In contrast, according to this embodiment, providing the ribs 220 can prevent the sheet P from being trapped by the lower-most portion 211 of the corner portion 210. Further, since the plurality of ribs 220 are employed as a structure for preventing the sheet P from being trapped by the lower-most portion 211 of the corner portion 210, heated air can be smoothly caused to pass through between the ribs 220 and to flow rearward for discharge.

A through-opening 116 is formed in the first wall 110 at a position overlapping the heating roller 71 as viewed from the upper-lower direction. Further, a fourth wall 140 protruding upward from the first wall 110 is integrally formed with the first wall 110. The fourth wall 140 is provided between the rear end portion 114 of the first wall 110 and the through-opening 116.

The through-opening 116 is formed to allow an actuator 118 to extend into the sheet conveyance passage 2A. The actuator 118 detects the presence or absence of a sheet P in the sheet conveyance passage 2A and is configured to be pivotally movable across a sheet ejection sensing mechanism 117. The through-opening 116 is formed in a center portion of the first wall 110 in the right-left direction.

With this configuration, even if a dew droplet entering the main body casing 2 through the exhaust opening 26 runs down along the upper surface of the first wall 110 toward the through-opening 116, the fourth wall 140 can receive the dew droplet. It is therefore possible to prevent dew droplets from dropping onto the heating roller 71 through the through-opening 116.

Further, the upper end of the fourth wall 140 is higher than the rear end portion 114 of the first wall 110. Accordingly, even if water gathers at the rear side of the fourth wall 140, the water will drop down from the rear end portion 114 before spilling over from the fourth wall 140. It is therefore possible to restrain water from dropping onto the heating roller 71 from the through-opening 116.

Although an illustrative embodiment of the present invention have been described in detail, the present invention is not limited to this specific embodiment. It is to be understood that various changes and modifications, such as those described below, may be made without departing from the scope of the appended claims. In the following description, parts similar to those previously described in the above embodiment are denoted by the same reference numerals and detailed description thereof will be omitted.

In the above exemplary embodiment, the front end portion 115 of the first wall 110 extends to a position substantially corresponding to the center 71A of the heating roller 71 in the front-rear direction. However, the present invention is not limited to this specific configuration. For example, as seen in FIG. 7, the first wall 110 may extend frontward beyond the center 71A of the heating roller 71.

With this configuration, since more than half of the heating roller 71 is covered by the first wall 110 from above, the amount of air heated by the heating roller 71 and guided toward the exhaust opening 26 by the first wall 110 can be increased. It is therefore possible to restrain hot air from being discharged through the sheet ejection opening 25 for sheets P.

Figure 7:
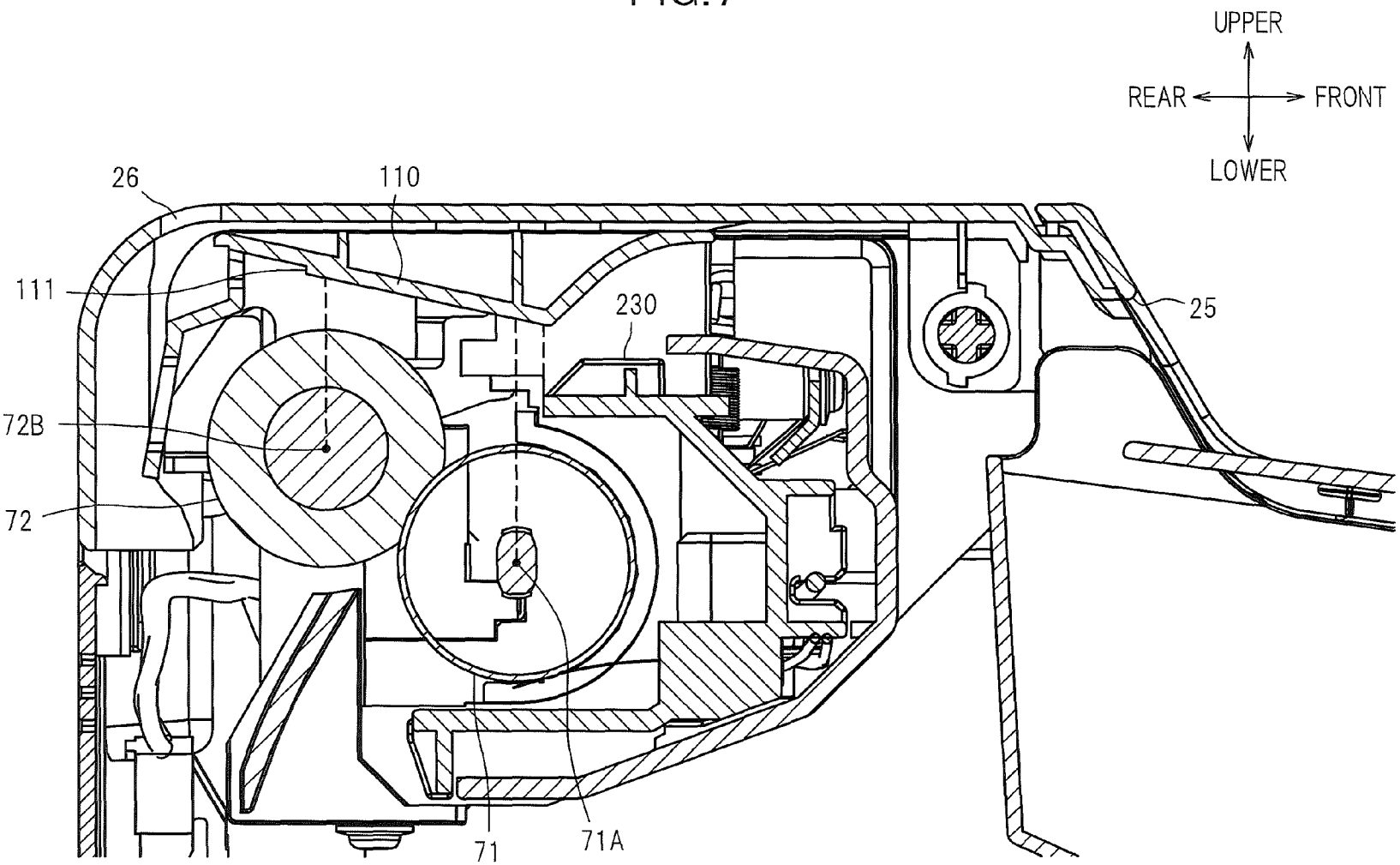
FIG. 7 is a sectional view showing a modified embodiment.

Further, as seen in FIG. 7, the first wall 110 may extend frontward beyond the rear ends of the guide ribs 230. With this configuration, the range of the heating roller 71 covered by the first wall 110 can be further increased as compared to the configuration in which, for example, the front end portion of the first wall is located in a position between the center 71A of the heating roller 71 and the rear ends of the guide ribs 230. Accordingly, the amount of air heated by the heating roller 71 and guided toward the exhaust opening 26 by the first wall 110 can be further increased, with the result that the hot air discharged through the sheet ejection opening 25 can be further suppressed. The present invention is not limited to this modified embodiment shown in FIG. 7, and the first wall 110 may extend directly above the rear end of the guide ribs 230.

Further, as seen in FIG. 7, it is preferable that the stepped portion 111 is located rearward of the center of the heating roller 72. This is because, even if a dew droplet stopped by the stepped portion 111 drops and hits the pressing roller 72, the dew droplet is less likely to splash to the heating roller 71.

In the above exemplary embodiments, the stepped portion 111 is provided as an example of an uneven portion. However, the present invention is not limited to this specific configuration. The uneven portion may be formed as a downwardly extending projection formed on the first wall 110 or an upwardly recessed portion in the first wall 110.

Further, in the above exemplary embodiments, the sheet P such as a cardboard, a postcard, and a thin paper, etc. is used as an example of a recording sheet. However, the present invention is not limited to this specific embodiment. For example, an OHP sheet may be used as the recording sheet.

In the above exemplary embodiments, the heating roller 71 is employed as an example of a heating member. However, the present invention is not limited to this specific configuration. For example, the heating member may comprise a nip plate and a fixing film, which are heated by a halogen lamp.

In the above exemplary embodiments, the pressure roller 72 is employed as an example of a pressing member. However, the present invention is not limited to this specific configuration. For example, a belt-type pressing member may be employed as the pressing member.

Further, in the above exemplary embodiment, the present invention is adapted to the laser printer 1. However, the present invention is not limited to this specific embodiment, and may be applicable to other image forming apparatuses such as a copying machine and a multifunction peripheral.

What is claimed is:

1. An image forming apparatus comprising:

a main body casing;

a fixing unit accommodated in the main body casing and including a heating member configured to thermally fix a developer image on a recording sheet, and a pressing member disposed opposite to the heating member at a position diagonally upward and rearward of the heating member and configured to convey the recording sheet while the recording sheet is nipped between the heating member and the pressing member;

a sheet ejection opening provide at a position frontward of the fixing unit in a front-rear direction of the image forming apparatus such that the recording sheet conveyed out from the fixing unit is ejected outside the main body casing through the sheet ejection opening;

an exhaust opening formed in the main body casing at a position rearward of the heating member in the front-rear direction such that air heated by heating member is discharged outside the main body casing through the exhaust opening;

a first wall provided inside the main body casing at a position above the heating member and the pressing member and extending diagonally downward and frontward from a position overlapping the exhaust opening as viewed from above to a position overlapping the heating member as viewed from above, the first wall having a lower surface facing the heating member and the pressing member and slanted such that a portion of the lower surface closer to the exhaust opening is higher than a portion of the lower surface closer to the heating member;

a stepped portion provided on the lower surface of the first wall at a position rearward of a front end portion of the pressing member, and configured to restrain a dew droplet condensed on the first wall from running down along the first wall; and a third wall extending diagonally upward and frontward from a front end portion of the first wall and configured to guide the recording sheet conveyed by the heating member and the pressing member to the sheet ejection opening, wherein a plurality of ribs are provided spaced apart from each other in a right-left direction, at a lower surface of a corner portion at which the first wall and the third wall are connected, and each of the ribs protrudes downward to form a downwardly narrowing portion, and wherein lower-most portions of the ribs are arranged rearward of a lower-most portion of the corner portion.

2. The image forming apparatus according to claim 1, wherein the first wall has a front portion and a rear portion shifted upward with respect to the front portion, and the stepped is provided between the front portion and the rear portion.

3. The image forming apparatus according to claim 2, wherein the stepped portion is located rearward of a center of the pressing member.

4. The image forming apparatus according to claim 1, wherein the first wall extends frontward beyond a center of the heating member.

5. The image forming apparatus according to claim 4, further comprising a guide member configured to support a lower surface of the recording sheet conveyed by the heating member and the pressing member and to guide the recording sheet to the sheet ejection opening, wherein the guide member is disposed frontward of the center of the heating member, and the first wall ends at a position directly above a rear end of the guide member or extends frontward beyond the rear end of the guide member.

6. The image forming apparatus according to claim 1, wherein the main body casing has an upper wall disposed above the first wall, and the exhaust opening is formed in the upper wall at a position overlapping a rear end portion of the first wall as viewed from an upper-lower direction.

7. The image forming apparatus according to claim 1, further comprising a second wall disposed inside the main body casing, wherein the second wall is disposed opposite to the first wall at a position below a rear end portion of the first wall and extends diagonally downward and rearward, and wherein the second wall has a front end portion which overlaps the rear end portion of the first wall as viewed from an upper-lower direction.

8. The image forming apparatus according to claim 1, wherein a through-opening is formed in the first wall at a position overlapping the heating member as viewed from an upper-lower direction, and wherein a fourth wall protruding upward from the first wall is provided between a rear end portion of the first wall and the through-opening.

9. The image forming apparatus according to claim 8, wherein an upper end of the fourth wall is higher than the rear end portion of the first wall.

10. The image forming apparatus according to claim 1, wherein the first wall and the third wall are integrally formed with each other.

11. An image forming apparatus comprising:

a main body casing;

a fixing unit accommodated in the main body casing and including a heating member configured to thermally fix a developer image on a recording sheet, and a pressing member disposed opposite to the heating member at a position diagonally upward and rearward of the heating member and configured to convey the recording sheet while the recording sheet is nipped between the heating member and the pressing member;

a first wall provided inside the main body casing at a position above the heating member and the pressing member and configured to extend diagonally downward and frontward;

an uneven portion provided on the first wall at a position rearward of a front end portion of the pressing member and configured to restrain a dew droplet condensed on the first wall from running down along the first wall;

a sheet ejection opening formed in the main body casing such that the recording sheet conveyed out from the fixing unit is ejected outside the main body casing through the sheet ejection opening;

an exhaust opening formed in the main body casing at a position rearward of the heating member such that air heated in the fixing unit is discharged outside the main body casing through the exhaust opening;

a third wall extending diagonally upward and frontward from a front end portion of the first wall and configured to guide the recording sheet conveyed by the heating member and the pressing member to the sheet ejection opening; and a plurality of ribs spaced apart from each other in a right-left direction at a lower surface of a corner portion at which the first wall and the third wall are connected, each of the ribs protruding downward to form a downwardly narrowing portion, lower-most portions of each of the ribs being arranged rearward of a lower-most portion of the corner portion.

12. The image forming apparatus according to claim 11, wherein the first wall has a front portion and a rear portion shifted upward with respect to the front portion, and the uneven portion is provided between the front portion and the rear portion.

13. The image forming apparatus according to claim 12, wherein the uneven portion is located rearward of a center of the pressing member.

14. The image forming apparatus according to claim 11, wherein the first wall extends front ward beyond a center of the heating member.

15. The image forming apparatus according to claim 14, further comprising a guide member configured to support a lower surface of the recording sheet conveyed by the heating member and the pressing member and to guide the recording sheet to the sheet ejection opening, wherein the guide member is disposed frontward of the center of the heating member, and the first wall ends at a position directly above a rear end of the guide member or extends frontward beyond the rear end of the guide member.

16. The image forming apparatus according to claim 11, wherein the main body casing has an upper wall disposed above the first wall, and the exhaust opening is formed in the upper wall at a position overlapping a rear end portion of the first wall as viewed from an upper-lower direction.

17. The image forming apparatus according to claim 11, further comprising a second wall disposed inside the main body casing, wherein the second wall is disposed opposite to the first wall at a position below a rear end portion of the first wall and extends diagonally downward and rearward, and wherein the second wall has a front end portion which overlaps the rear end portion of the first wall as viewed from an upper-lower direction.

18. The image forming apparatus according to claim 11, wherein a through-opening is formed in the first wall at a position overlapping the heating member as viewed from an upper-lower direction, and wherein a fourth wall protruding upward from the first wall is provided between a rear end portion of the first wall and the through-opening.

19. The image forming apparatus according to claim 18, wherein an upper end of the fourth wall is higher than the rear end portion of the first wall.

20. The image forming apparatus according to claim 11, wherein the first wall and the third wall are integrally formed with each other.

* * * * *